US007476181B1

(12) United States Patent
Honda

(10) Patent No.: US 7,476,181 B1
(45) Date of Patent: Jan. 13, 2009

(54) EXERCISE APPARATUS WITH DUAL FUNCTION COMMON STOP SWITCH ASSEMBLY

(75) Inventor: Edward A. Honda, Chicago, IL (US)

(73) Assignee: Brunswick Corporation, Lake Forest, IL (US)

( * ) Notice: Subject to any disclaimer, the term of this patent is extended or adjusted under 35 U.S.C. 154(b) by 763 days.

(21) Appl. No.: 11/018,705

(22) Filed: Dec. 21, 2004

(51) Int. Cl.
*A63B 22/02* (2006.01)

(52) U.S. Cl. ..... 482/54; 482/51; 482/8; 482/900

(58) Field of Classification Search ..... 482/51, 482/54, 1–9, 57, 900–902; 119/700
See application file for complete search history.

(56) References Cited

U.S. PATENT DOCUMENTS 6,241,638 B1 * 6/2001 Hurt ..... 482/54
6,270,445 B1 * 8/2001 Dean et al. ..... 482/4

* cited by examiner

*Primary Examiner*—Glenn Richman
(74) *Attorney, Agent, or Firm*—Andrus, Sceales, Starke & Sawall, LLP

(57) ABSTRACT

Exercise apparatus, including treadmills having an endless loop belt driven by an electric motor to exercise the user, has a dual function common stop switch assembly at a singular location on a control console, which assembly has first and second switches each actuatable separately from each other to independently stop the exercise movement member such as a treadbelt. The construction eliminates separately located stop switches.

30 Claims, 7 Drawing Sheets

EXERCISE APPARATUS WITH DUAL FUNCTION COMMON STOP SWITCH ASSEMBLY

BACKGROUND AND SUMMARY

The invention relates to exercise apparatus having a user-engagable exercise movement member driven by an electric motor to exercise the user, for example treadmills and other types of exercise apparatus.

Treadmills are known in the prior art and typically have a user-engagable exercise movement member provided by an endless loop belt driven by an electric motor to exercise the user, e.g. walking or running. The motor is connectable to an electric power source, and energization of the motor is controlled at a control console having a keypad, a display screen, and the like, and further typically involving software based control functions enabling various routines and programs as selected by the user. The console typically includes a stop switch button manually depressible by the user to stop the treadmill by disconnecting the motor from the power source, including under software based control. The console also typically includes an emergency stop switch connected by a tether cord or lanyard to the user for stopping the treadmill in the event of a trip or fall by the user.

The noted two stop functions are performed by two separate switches and mechanisms on the front the console. It has been observed that some users can be confused by the presence of two stop switches, and may, for example, attempt to actuate the emergency stop switch for normal end-of-session stoppage or the like. The present invention provides a simple and effective solution, as well as other benefits and advantages.

DETAILED DESCRIPTION

Figure 1:
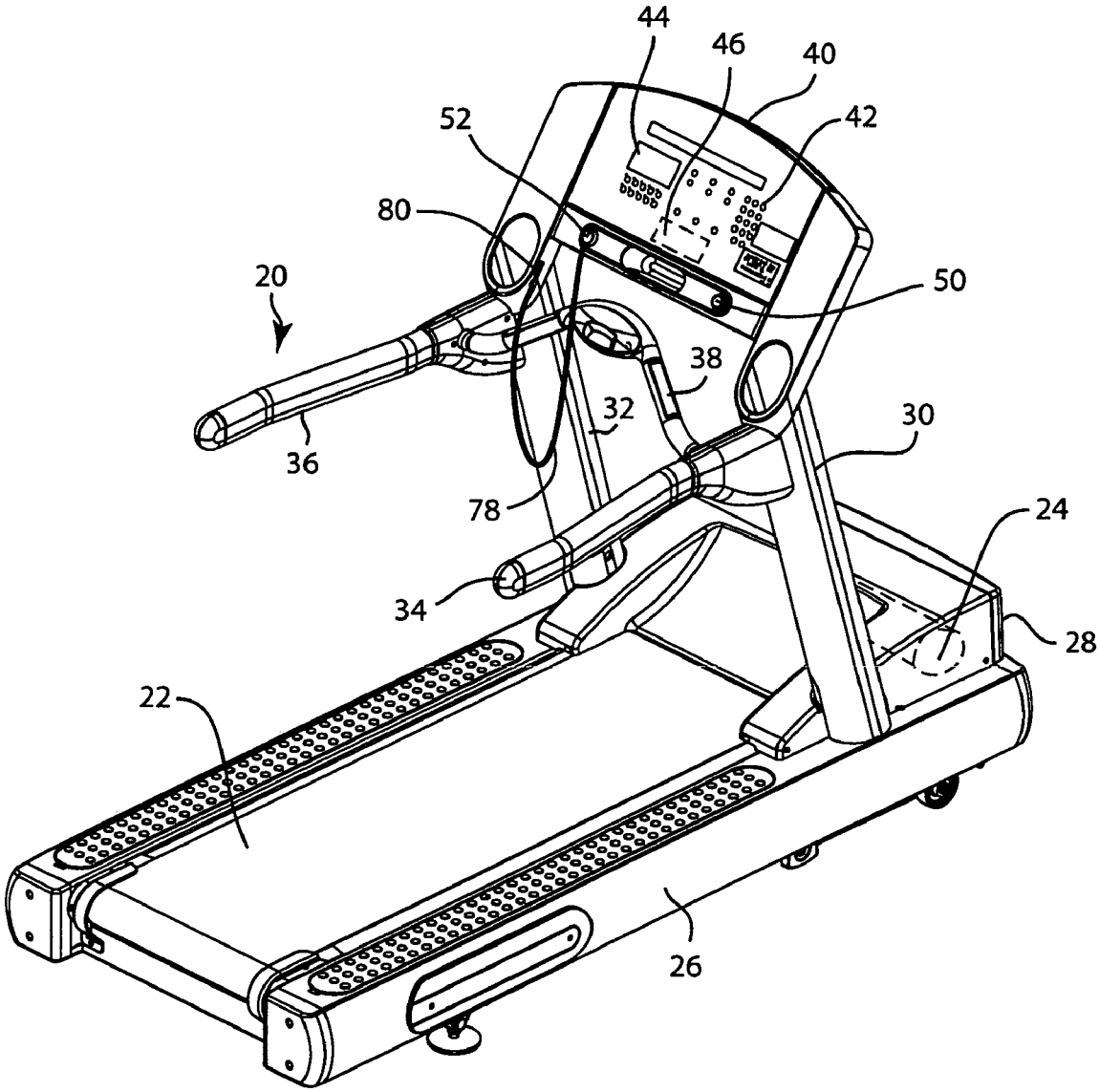
FIG. 1 is a perspective view of exercise apparatus in accordance with the invention.
Figure 2:
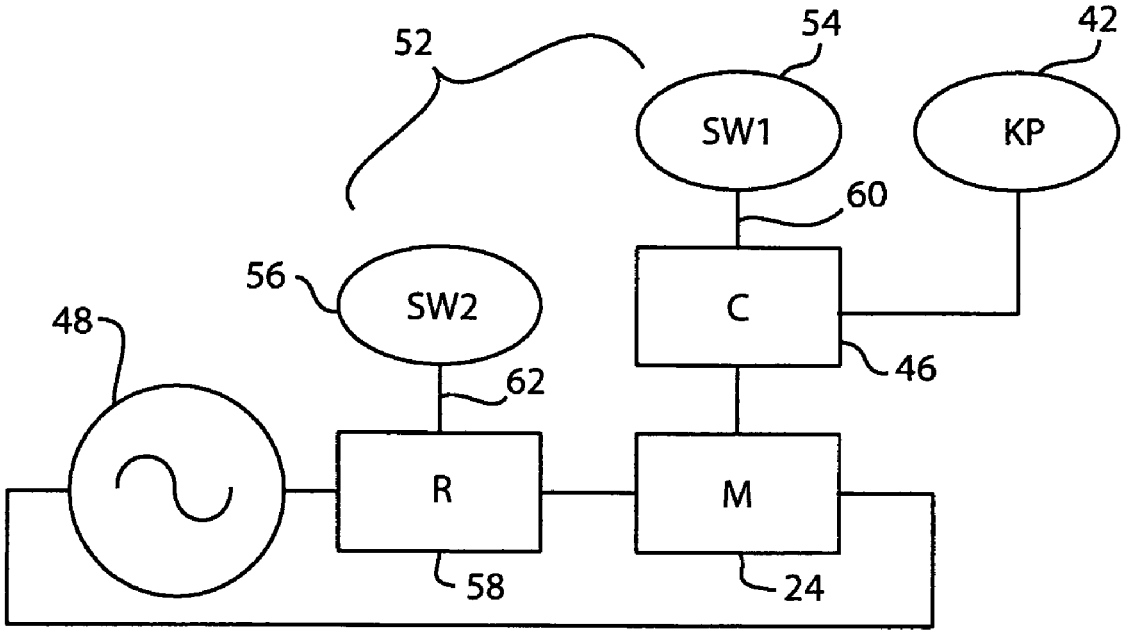
FIG. 2 is a schematic electrical diagram for the exercise apparatus of FIG. 1.
Figure 3:
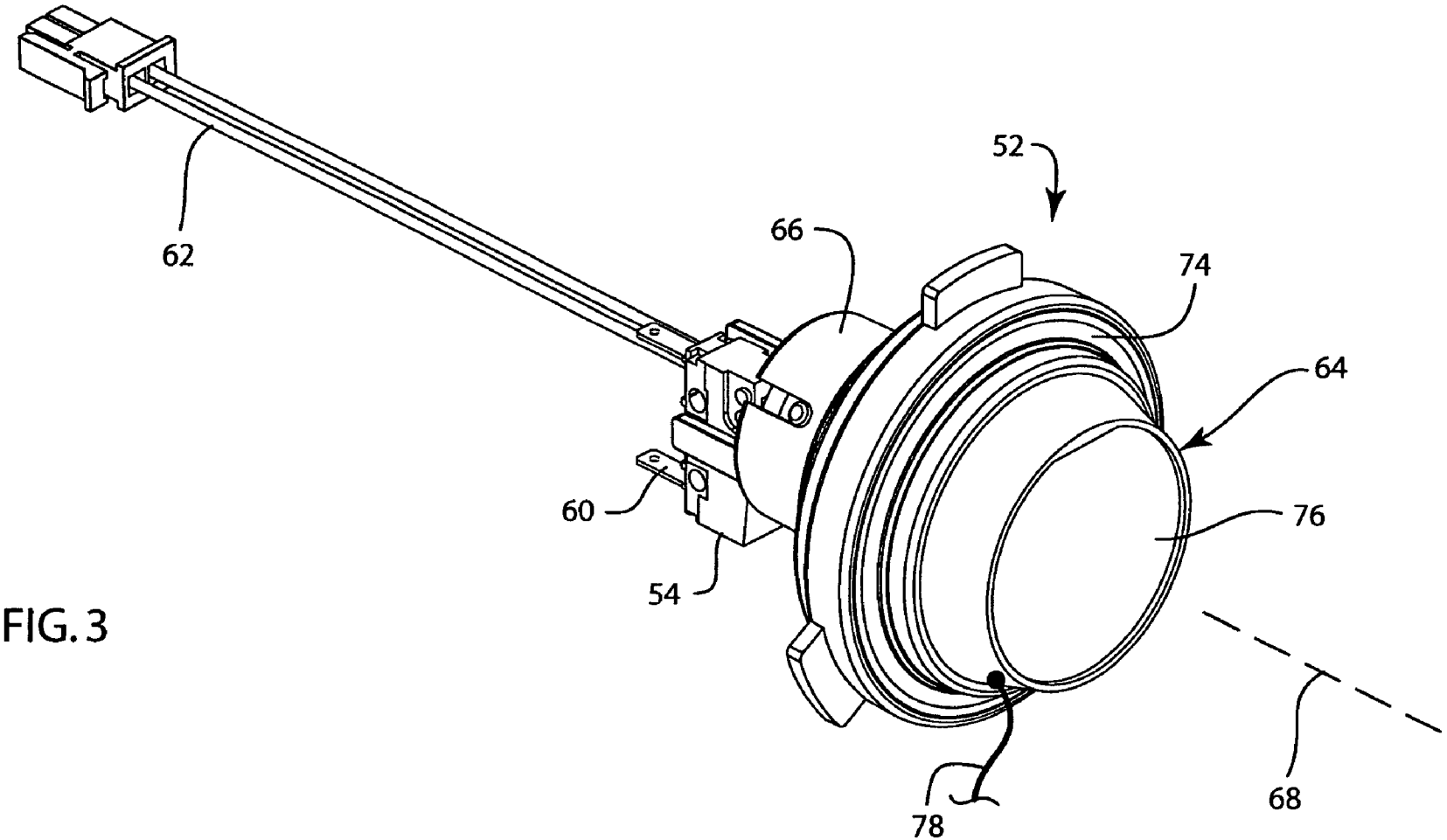
FIG. 3 is a perspective view of a component of FIG. 1.
Figure 4:
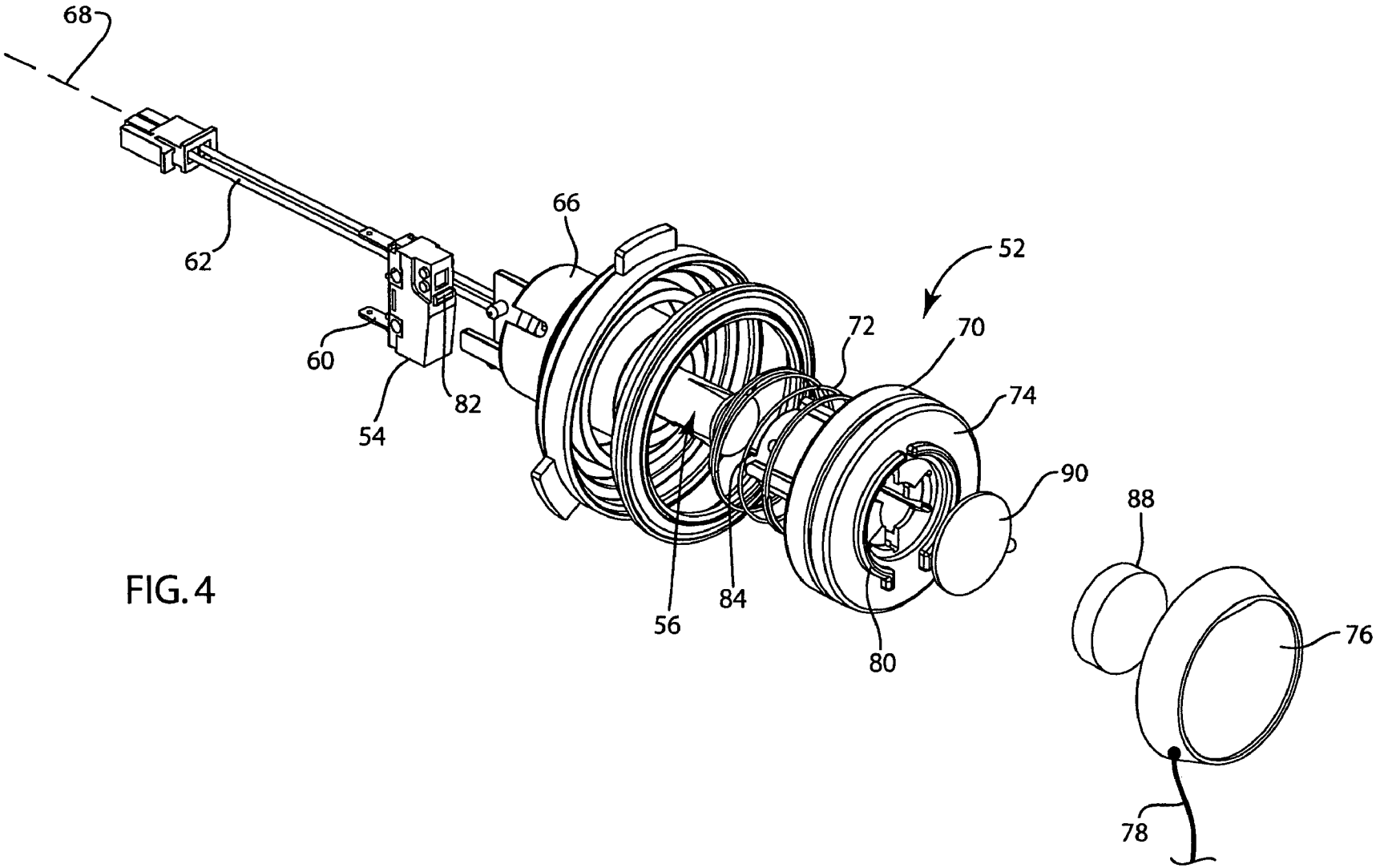
FIG. 4 is an exploded perspective view of the assembly of FIG. 3.
Figure 5:
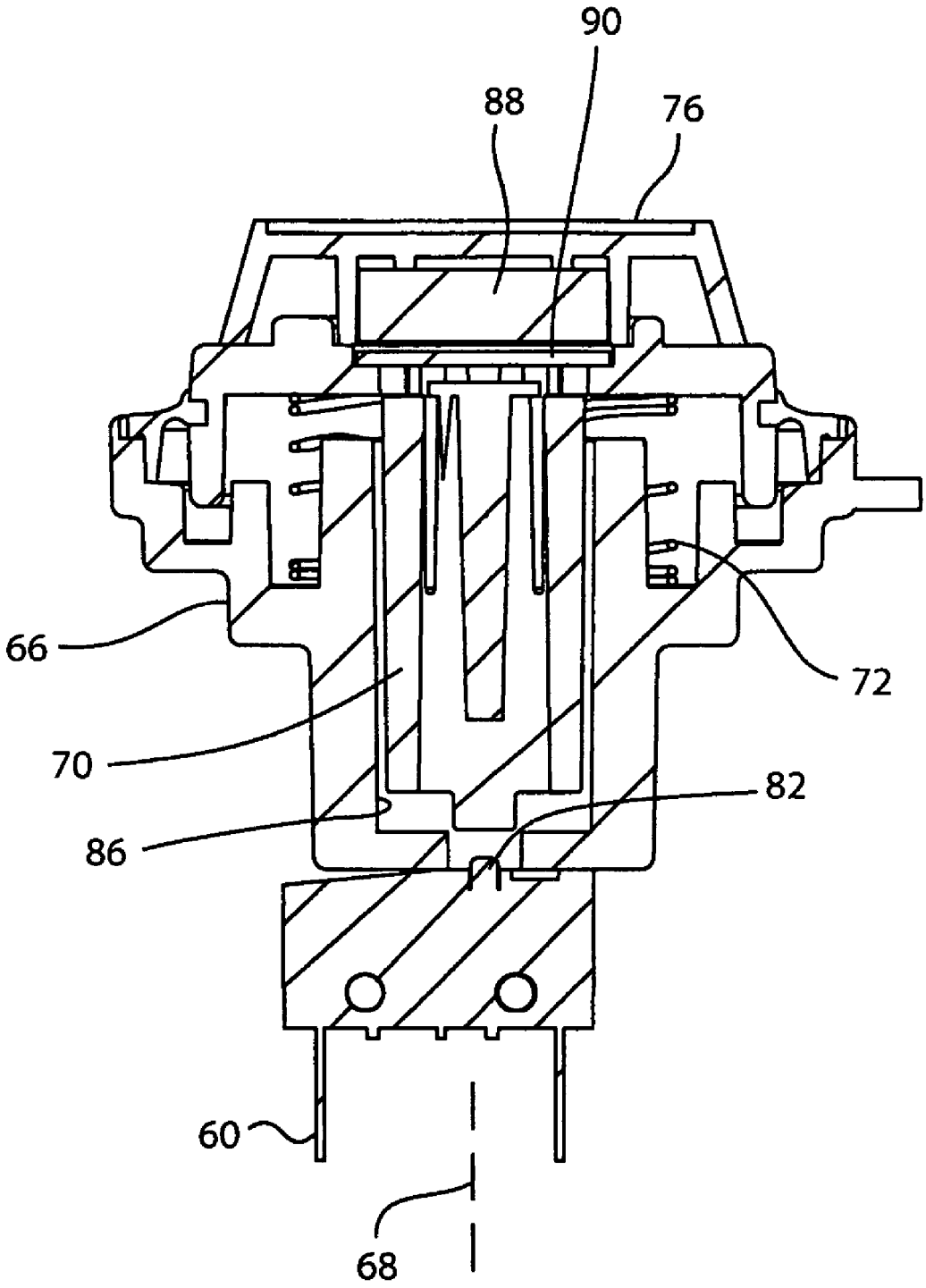
FIG. 5 is a sectional view of the assembly of FIG. 3.
Figure 6:
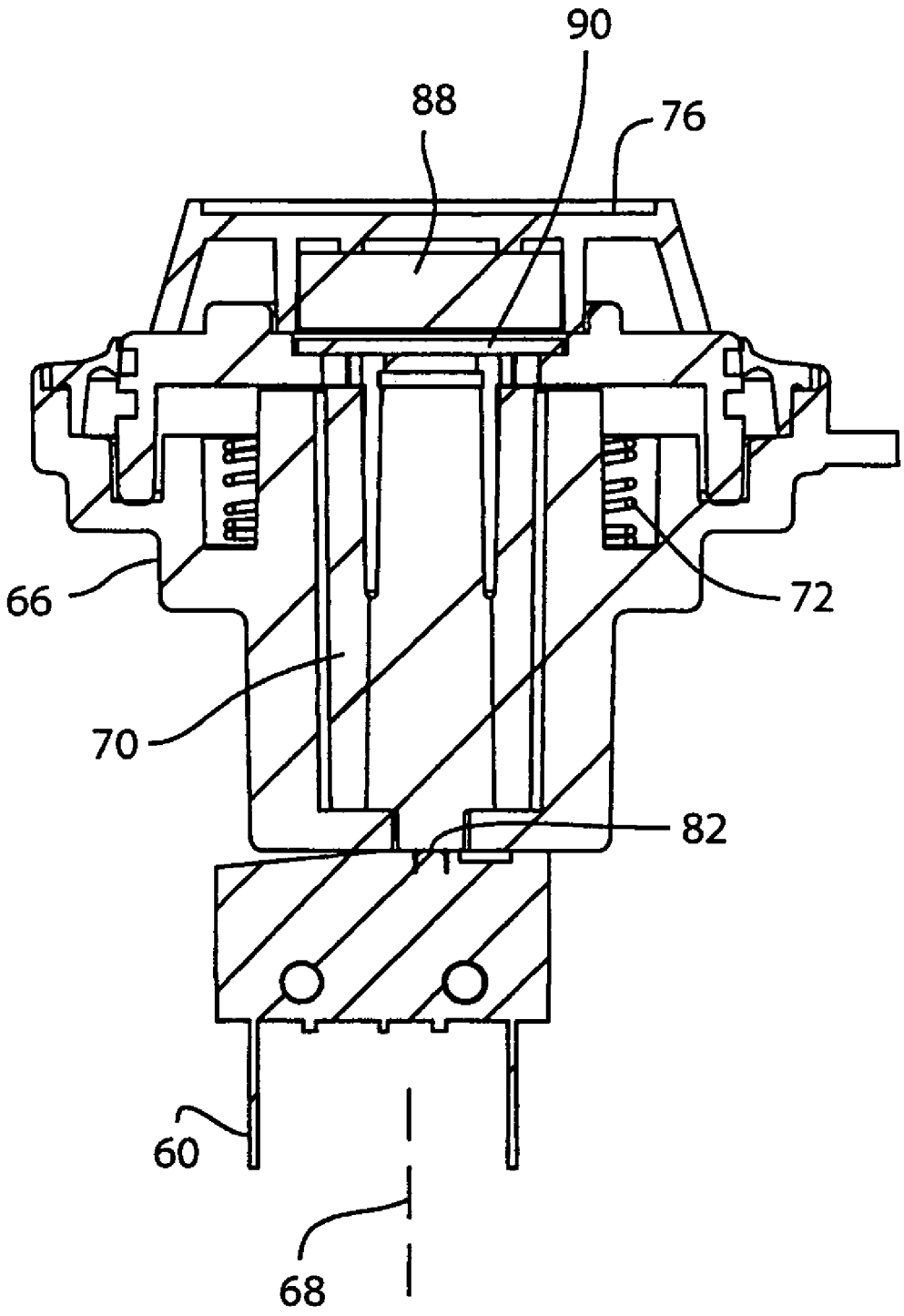
FIG. 6 is like FIG. 5 and shows an actuated condition.
Figure 7:
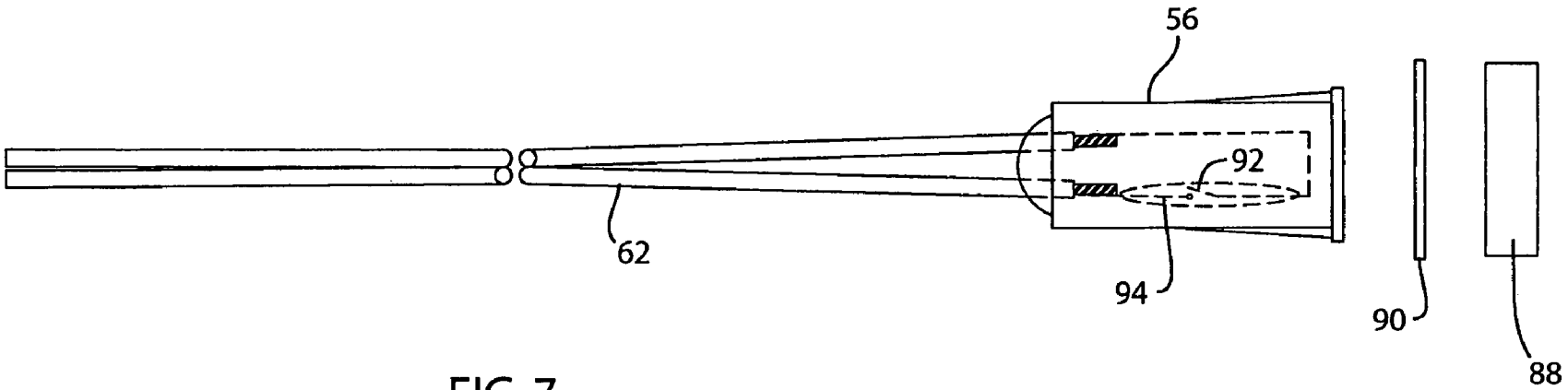
FIG. 7 is a side view of a portion of FIG. 4.
Figure 8:
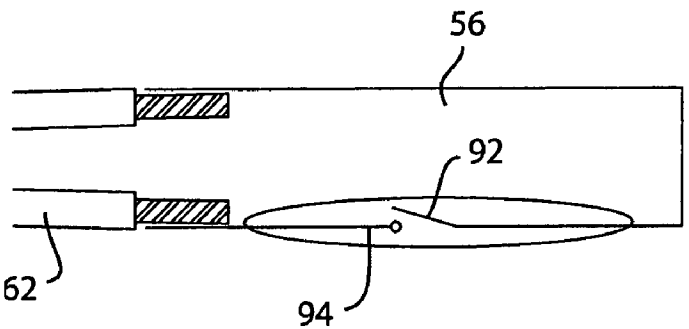
FIG. 8 is a view of a portion of FIG. 7.

FIG. 1 shows exercise apparatus 20, such as a treadmill, having a user-engagable movement member, such as endless loop treadbelt 22, driven by an electric motor 24 to exercise the user, e.g. walking or running on moving belt 22. As is known, the belt is supported on a stationary frame 26 having a front shroud 28 enclosing motor 24, and having upstanding supports 30, 32 supporting side handlebars 34, 36 and a central bridging handlebar 38 therebetween, and also supporting a control console 40 having one or more keypads (KP) such as 42 and display screens such as 44 for various software-based programs and routines coordinated through a central processor or control (C) 46. The motor (M) is connectable to an electric power source 48, FIG. 2. The console has a start switch 50 for starting the motor through the software-based controller 46. The control console also has a dual function common stop switch assembly 52 having first and second switches (SW1 and SW2) 54 and 56, to be described, each actuatable to stop belt 22, preferably by disconnecting motor 24 from power source 48. Switch 54 preferably disconnects motor 24 from power source 48 through controller 46. Switch 56 preferably disconnects motor 24 from power source 48 by relay (R) 58.

The first and second switches 54 and 56 are actuatable independently of each other to separately and independently of each other stop exercise movement member 22. The switches are each actuatable to stop member 22 by disconnecting motor 24 from power source 48. First and second circuits 60 and 62, FIGS. 2-8, are respectively connected to the first and second switches 54 and 56 and separately control disconnection of motor 24 from power source 48. Dual function common stop switch assembly 52 has a switch actuator 64, FIG. 3, on control console 40. Each of switches 54 and 56 is actuated by the same such switch actuator 64. Switch actuator 64 is actuatable in a first actuation mode to actuate first switch 54, and is actuatable in a second actuation mode to actuate second switch 56. The first actuation mode is a first direction of actuation movement, to be described, of switch actuator 64 to actuate switch 54. The second actuation mode is a second direction of actuation movement, to be described, of switch actuator 64 to actuate switch 56, which second direction is different than the noted first direction.

Dual function common stop switch assembly 52 includes a switch body 66, FIGS. 3-6, mounted to control console 40 and extending axially thereinto along axis 68, a movable piston 70 axially slidable in switch body 66 against the bias of compression spring 72 and having an outer axial end 74 facing the user, and a switch cap 76 removably attached to piston 70 at outer axial end 74 and connectable to the user by a tether cord 78 attached to cap 76 by epoxy, a tied knot, or the like. The end of the tether cord has a clip 80 which is preferably clipped to apparatus 20 when not in use, and is clipped to clothing of the user when in use. First switch 54 is actuated by axial depression of switch cap 76 to axially depress piston 70 along axis 68 (leftwardly in FIGS. 3 and 4, downwardly in FIGS. 5 and 6). Second switch 56 is actuated by removal of switch cap 76 from outer axial end 74 of piston 70 by tether cord 78. Switch cap 76 is preferably mounted to axial end 74 of plunger 70 in snap fit friction fit, for example at one or more raised bosses such as 80 on outer axial end 74 onto which switch cap 76 can be snapped on and off.

First switch 54 is actuated by the noted axial movement of piston 70. Switch 54 is preferably a mechanical snap action momentary switch having a plunger 82 engaged and actuated by shoulder or trunnion 84 of piston 70 during axial depression thereof along axis 68. Second switch 56 is mounted to and within piston 70 and is movable therewith and is coupled to switch cap 76 and is actuated by the noted removal of switch cap 76 from outer axial end 74 of piston 70 by tether cord 78. Piston 70 has a hollow interior 86, FIG. 5. Second switch 56 is preferably a magnetic reed switch, FIGS. 7, 8, located in hollow interior 86 of piston 70. Switch cap 76 has a magnet 88 attached thereto, e.g. by epoxy. The noted coupling of second switch 56 to switch cap 76 is a magnetic coupling of the magnetic reed switch to magnet 88 of switch cap 76. A magnetic flux coupling disc 90, e.g. steel, is provided on outer axial end 74 of piston 70 and magnetically couples magnetic reed switch 56 and magnet 88. Magnetic reed switch 56 is actuated by removal of switch cap 76 from outer axial end 74 of piston 70 by tether cord 78, breaking the magnetic flux field otherwise causing attraction of reeds 92 and 94 such that the reeds separate, FIG. 8.

The noted first actuation mode is a first direction of actuation movement extending axially into control console 40 away from the user, i.e. axial depression of switch cap 76 along axis 68. The noted second actuation mode is a second direction of actuation movement of switch cap 76 as tether cord 78 pulls switch cap 76 away from outer axial end 74 of plunger 70. First and second switches 54 and 56 are axially spaced from each other along axis 68. Second switch 56 is axially between first switch 54 and switch cap 76. Second switch 56 is movable with piston 70 of switch actuator 64 relative to first switch 54. Second switch 56 moves axially toward first switch 54 upon actuation of the switch actuator in the noted first direction of actuation movement.

The disclosed construction provides a dual function common stop switch assembly 52 for exercise apparatus 20 having a user-engagable exercise movement member 22 driven by an electric motor 24 to exercise the user. The dual function stop switch assembly has first and second switches 54 and 56 in a common stop switch assembly for mounting at a singular location on control console 40, rather than separate locations, yet each of the first and second switches 54 and 56 is actuatable separately from each other to independently stop exercise movement member 22.

It is recognized that various equivalents, alternatives and modifications are possible within the scope of the appended claims.

What is claimed is:

1. Exercise apparatus comprising a user-engagable exercise movement member driven by an electric motor to exercise the user, said motor being connectable to an electric power source, said apparatus having a control console with a dual function stop switch assembly having first and second switches each actuatable to stop said exercise movement member, wherein said dual function stop switch assembly comprises a switch actuator on said control console, each of said first and second switches being actuated by the same said switch actuator, said switch actuator being actuatable in a first actuation mode to actuate said first switch, said switch actuator being actuatable in a second actuation mode to actuate said second switch.

2. The exercise apparatus according to claim 1 wherein said first actuation mode is a first direction of actuation movement of said switch actuator to actuate said first switch, and said second actuation mode is a second direction of actuation movement of said switch actuator to actuate said second switch, said second direction being different than said first direction.

3. The exercise apparatus according to claim 1 wherein said first actuation mode is a first direction of actuation movement extending axially into said control console away from the user.

4. The exercise apparatus according to claim 3 wherein said first and second switches are axially spaced from each other.

5. The exercise apparatus according to claim 4 wherein said switch actuator comprises a switch cap for axially depressing said switch actuator, and said second switch is axially between said first switch and said switch cap.

6. The exercise apparatus according to claim 1 wherein said second switch is movable with said switch actuator relative to said first switch.

7. The exercise apparatus according to claim 6 wherein:

said first actuation mode is a first direction of actuation movement extending axially into said control console away from the user;

said first and second switches are axially spaced from each other; and said second switch moves axially toward said first switch upon actuation of said switch actuator in said first direction of actuation movement.

8. Exercise apparatus comprising a user-engagable exercise movement member driven by an electric motor to exercise the user, said motor being connectable to an electric power source, said apparatus having a control console with a dual function stop switch assembly having first and second switches each actuatable to stop said exercise movement member, wherein said dual function stop switch assembly comprises a switch actuator on said control console, each of said first and second switches being actuated by the same said switch actuator, said switch actuator being actuatable in a first actuation mode to actuate said first switch, said switch actuator being actuatable in a second actuation mode to actuate said second switch, and wherein said dual function stop switch assembly comprises a switch body mounted to said control console and extending axially thereinto, a movable piston axially slidable in said switch body and having an outer axial end axially facing the user, a switch cap removably attached to said piston at said outer axial end and connectable to the user by a tether cord, said first switch being actuated by axial depression of said switch cap by the user to axially depress said piston, said second switch being actuated by removal of said switch cap from said outer axial end of said piston by said tether cord.

9. The exercise apparatus according to claim 8 wherein said first switch is actuated by axial movement of said piston, and said second switch is mounted to said piston and is movable therewith and is coupled to said switch cap and is actuated by said removal of said switch cap from said outer axial end of said piston.

10. The exercise apparatus according to claim 9 wherein said piston has a hollow interior, and said second switch is located in said hollow interior of said piston.

11. The exercise apparatus according to claim 10 wherein said second switch is a magnetic reed switch, said switch cap has a magnet attached thereto, and said coupling of said second switch to said switch cap is a magnetic coupling of said magnetic reed switch to said magnet of said switch cap.

12. The exercise apparatus according to claim 11 comprising a magnetic flux coupling disc on said outer axial end of said piston between and magnetically coupling said magnetic reed switch and said magnet.

13. The exercise apparatus according to claim 8 wherein in combination:

said first switch is a mechanical snap action momentary switch engaged and actuated by said piston during said axial depression thereof; and said second switch is a magnetic reed switch actuated by said removal of said switch cap from said outer axial end of said piston by said tether cord.

14. Exercise apparatus comprising a user-engagable exercise movement member driven by an electric motor to exercise the user, said motor being connectable to an electric power source, said apparatus having a control console with first and second switches in a common stop switch assembly at a singular location on said control console, each of said first and second switches actuatable separately from each other to independently stop said exercise movement member, wherein said common stop switch assembly comprises a switch actuator on said control console, each of said first and second switches being actuated by said switch actuator, said switch actuator being actuatable in a first actuation mode to actuate said first switch, said switch actuator being actuatable in a second actuation mode to actuate said second switch, said switch actuator comprising an axially movable piston having a switch cap removably attached thereto for axially depressing said piston into said control console, said first switch being actuated by said piston to provide said first actuation mode, said second switch being actuated by said switch cap to provide said second actuation mode.

15. The exercise apparatus according to claim 14 wherein said second switch is actuated by removal of said switch cap from said piston.

16. A dual function stop switch assembly for exercise apparatus having a user-engagable exercise movement member driven by an electric motor to exercise the user, said motor being connectable to an electric power source, said apparatus having a control console, said dual function stop switch assembly comprising first and second switches in a common stop switch assembly for mounting at a singular location on said control console, each of said first and second switches being actuatable separately from each other to independently stop said exercise movement member, wherein said common stop switch assembly comprises a switch actuator on said control console, each of said first and second switches being actuated by said switch actuator, said switch actuator being actuatable in a first actuation mode to actuate said first switch, said switch actuator being actuatable in a second actuation mode to actuate said second switch, said switch actuator comprising an axially movable piston having a switch cap removably attached thereto for axially depressing said piston into said control console, said first switch being actuated by said piston to provide said first actuation mode, said second switch being actuated by said switch cap to provide said second actuation mode.

17. The dual function stop switch assembly according to claim 16 wherein said second switch is actuated by removal of said switch cap from said piston.

18. A dual function stop switch assembly for exercise apparatus having a user-engagable exercise movement member driven by an electric motor to exercise the user, said motor being connectable to an electric power source, said apparatus having a control console, said dual function stop switch assembly comprising first and second switches in a common stop switch assembly for mounting at a singular location on said control console, each of said first and second switches being actuatable separately from each other to independently stop said exercise movement member, wherein said common stop switch assembly comprises a switch actuator on said control console, each of said first and second switches being actuated by the same said switch actuator, said switch actuator being actuatable in a first actuation mode to actuate said first switch, said switch actuator being actuatable in a second actuation mode to actuate said second switch.

19. The dual function stop switch assembly according to claim 18 wherein said first actuation mode is a first direction of actuation movement of said switch actuator to actuate said first switch, and said second actuation mode is a second direction of actuation movement of said switch actuator to actuate said second switch, said second direction being different than said first direction.

20. The dual function stop switch assembly according to claim 18 wherein said first actuation mode is a first direction of actuation movement extending axially into said control console away from the user.

21. A dual function stop switch assembly for exercise apparatus having a user-engagable exercise movement member driven by an electric motor to exercise the user, said motor being connectable to an electric power source, said apparatus having a control console, said dual function stop switch assembly comprising first and second switches in a common stop switch assembly for mounting at a singular location on said control console each of said first and second switches being actuatable separately from each other to independently stop said exercise movement member, wherein said common stop switch assembly comprises a switch actuator on said control console, each of said first and second switches being actuated by the same said switch actuator, said switch actuator being actuatable in a first actuation mode to actuate said first switch, said switch actuator being actuatable in a second actuation mode to actuate said second switch, and wherein said common stop switch assembly comprises a switch body mounted to said control console and extending axially thereinto, a movable piston axially slidable in said switch body and having an outer axial end axially facing the user, a switch cap removably attached to said piston at said outer axial end and connectable to the user by a tether cord, said first switch being actuated by axial depression of said switch cap by the user to axially depress said piston, said second switch being actuated by removal of said switch cap from said outer axial end of said piston by said tether cord.

22. The dual function stop switch assembly according to claim 21 wherein said first switch is actuated by axial movement of said piston, and said second switch is mounted to said piston and is movable therewith and is coupled to said switch cap and is actuated by removal of said switch cap from said outer axial end of said piston.

23. The dual function stop switch assembly according to claim 22 wherein said piston has a hollow interior, and said second switch is located in said hollow interior of said piston.

24. The dual function stop switch assembly according to claim 23 wherein said second switch is a magnetic reed switch, said switch cap has a magnet attached thereto, and said coupling of said second switch to said switch cap is a magnetic coupling of said magnetic reed switch to said magnet of said switch cap.

25. The dual function stop switch assembly according to claim 24 comprising a magnetic flux coupling disc on said outer axial end of said piston between and magnetically coupling said magnetic reed switch and said magnet.

26. The dual function stop switch assembly according to claim 21 wherein in combination:

said first switch is a mechanical snap action momentary switch engaged and actuated by said piston during said axial depression thereof; and said second switch is a magnetic reed switch actuated by said removal of said switch cap from said outer axial end of said piston by said tether cord.

27. The dual function stop switch assembly according to claim 20 wherein said first and second switches are axially spaced from each other.

28. The dual function stop switch assembly according to claim 27 wherein said switch actuator comprises a switch cap for axially depressing said switch actuator, and said second switch is axially between said first switch and said switch cap.

29. The dual function stop switch assembly according to claim 18 wherein said second switch is movable with said switch actuator relative to said first switch.

30. The dual function stop switch assembly according to claim 29 wherein:

said first actuation mode is a first direction of actuation movement extending axially into said control console away from the user;

said first and second switches are axially spaced from each other; and said second switch moves axially toward said first switch upon actuation of said switch actuator in said first direction of actuation movement.

* * * * *